US010039958B2

(12) United States Patent
Sato

(10) Patent No.: US 10,039,958 B2
(45) Date of Patent: Aug. 7, 2018

(54) GOLF BALL

(71) Applicant: Bridgestone Sports Co., Ltd., Minato-ku, Tokyo (JP)

(72) Inventor: Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 17 days.

(21) Appl. No.: 14/959,263

(22) Filed: Dec. 4, 2015

(65) Prior Publication Data

US 2016/0184644 A1 Jun. 30, 2016

(30) Foreign Application Priority Data

Dec. 26, 2014 (JP) ..... 2014-265879

(51) Int. Cl.
*A63B 37/00* (2006.01)

(52) U.S. Cl.
CPC ..... *A63B 37/0004* (2013.01); *A63B 37/002* (2013.01); *A63B 37/0007* (2013.01); *A63B 37/0009* (2013.01); *A63B 37/0018* (2013.01); *A63B 37/0019* (2013.01); *A63B 37/0021* (2013.01); *A63B 37/0077* (2013.01); *A63B 37/0096* (2013.01)

(58) Field of Classification Search
CPC ..... A63B 37/0004; A63B 37/0007; A63B 37/0009; A63B 37/0077
See application file for complete search history.

(56) References Cited

U.S. PATENT DOCUMENTS

| | | | | | |
|---|---|---|---|---|---|
| 5,106,096 | A * | 4/1992 | Dunn | A63B 37/0004 | 473/383 |
| 6,010,442 | A * | 1/2000 | Lemons | A63B 37/0004 | 473/384 |
| 6,019,688 | A * | 2/2000 | Sullivan | A63B 37/0004 | 473/383 |
| 6,231,463 | B1 * | 5/2001 | Tavares | A63B 37/0004 | 473/378 |
| 6,626,772 | B1 * | 9/2003 | Kennedy, III | A63B 37/0004 | 473/384 |
| 2004/0087389 | A1 * | 5/2004 | Kasashima | A63B 37/0004 | 473/383 |
| 2006/0068939 | A1 * | 3/2006 | Sato | A63B 37/0004 | 473/378 |
| 2007/0167258 | A1 * | 7/2007 | Sato | A63B 37/0004 | 473/378 |

(Continued)

FOREIGN PATENT DOCUMENTS

| | | | |
|---|---|---|---|
| JP | 2002-531232 | A | 9/2002 |
| JP | 2006-095281 | A | 4/2006 |

*Primary Examiner* — John E Simms, Jr.
(74) *Attorney, Agent, or Firm* — Sughrue Mion, PLLC

(57) ABSTRACT

A golf ball includes plural dimples formed on a surface thereof and plural depressed or protruded portions spaced apart from each other and arranged along an outer periphery of at least one of the plural dimples. The plural depressed or protruded portions each has, as a part of a contour thereof, a shape substantially similar to a part of a contour of the dimple surrounded with the plural depressed or protruded portions. The plural depressed or protruded portions each has a length of more than 1/10 and less than 1/2 of an outer peripheral length of the dimple surrounded with the plural depressed or protruded portions.

7 Claims, 5 Drawing Sheets

(56) References Cited

U.S. PATENT DOCUMENTS

| | | | | |
|---|---|---|---|---|
| 2008/0261725 | A1* | 10/2008 | Olson | A63B 37/0007 473/384 |
| 2009/0111613 | A1* | 4/2009 | Sato | A63B 37/0007 473/383 |
| 2010/0240472 | A1* | 9/2010 | Nardacci | A63B 37/0004 473/383 |
| 2012/0184395 | A1* | 7/2012 | Kasashima | A63B 37/0031 473/373 |
| 2012/0302378 | A1* | 11/2012 | Sato | A63B 37/0006 473/384 |
| 2013/0005510 | A1* | 1/2013 | Kim | G06F 17/50 473/384 |
| 2014/0004977 | A1* | 1/2014 | Hwang | A63B 37/0004 473/384 |
| 2014/0200099 | A1* | 7/2014 | Aoyama | A63B 37/0007 473/383 |

* cited by examiner

GOLF BALL

CROSS-REFERENCE TO RELATED APPLICATION

This Application claims priority from Japanese Patent Application No. 2014-265879 filed Dec. 26, 2014, which is incorporated herein by reference in its entirety.

FIELD OF THE INVENTION

The present invention relates to a golf ball, and more specifically relates to a golf ball with a specific configuration arranged on an outer periphery of a dimple.

BACKGROUND OF THE INVENTION

It has been well known that in designing a golf ball, in order to achieve a long flying distance when the golf ball is hit, it is important that the resilience of the golf ball itself be high and the air resistance generated due to dimples arranged on the surface of the golf ball during its flight is reduced.

JP 2002-531232 A discloses a dual dimple configuration, in which a center recess and an annular recess are arranged in a specific condition.

SUMMARY OF THE INVENTION

In order to improve the flight distance of a golf ball, it is essential to improve its aerodynamic performance. The aerodynamic performance is considered to improve when a flow of air effectively enters the inside of the dimples and unevenness of the effect of the dimples is thus reduced.

The object of the present invention is to provide a golf ball having a structure capable of increasing the effects of dimples and exhibiting an excellent aerodynamic performance.

In order to achieve the object mentioned above, the present invention provides a golf ball including: plural dimples formed on a surface thereof; and plural depressed or protruded portions spaced apart from each other and arranged along an outer periphery of at least one of the plural dimples, the plural depressed or protruded portions each having, as a part of a contour thereof, a shape substantially similar to a part of a contour of the dimple surrounded with the plural depressed or protruded portions, the plural depressed or protruded portions each having a length of more than 1/10 and less than 1/2 of an outer peripheral length of the dimple surrounded with the plural depressed or protruded portions.

A distance between the plural depressed or protruded portions and the dimple surrounded with the plural depressed or protruded portions may be at most 1 mm. A depth of the depressed portion or a height of the protruded portion may be at most 0.5 mm.

The contour of the depressed or protruded portion may include a first part adjacent to the dimple and a second part opposite thereto, the first and second parts each having a shape of a circular arc, the circular arcs being concentric. Alternatively, the contour of the depressed or protruded portion may include a first part adjacent to the dimple and a second part opposite thereto, the first part having a shape of a straight line, the second part having a shape of a curve. The plural depressed or protruded portions may be arranged doubly or more along the outer periphery of the dimple.

According to the present invention, a plurality of depressed portions or protruded portions including a part of a contour having a shape substantially similar to the shape of the dimple is intermittently arranged on the outer periphery of the dimple, and thus the air is intentionally disturbed before flowing into the dimple, and thereby the effect of the dimples can be increased and the aerodynamic performance can be improved.

DETAILED DESCRIPTION OF THE INVENTION

Hereinafter, embodiments of a golf ball according to the present invention will be described with reference to the accompanying drawings, but the present invention is not limited thereto.

Figure 1:
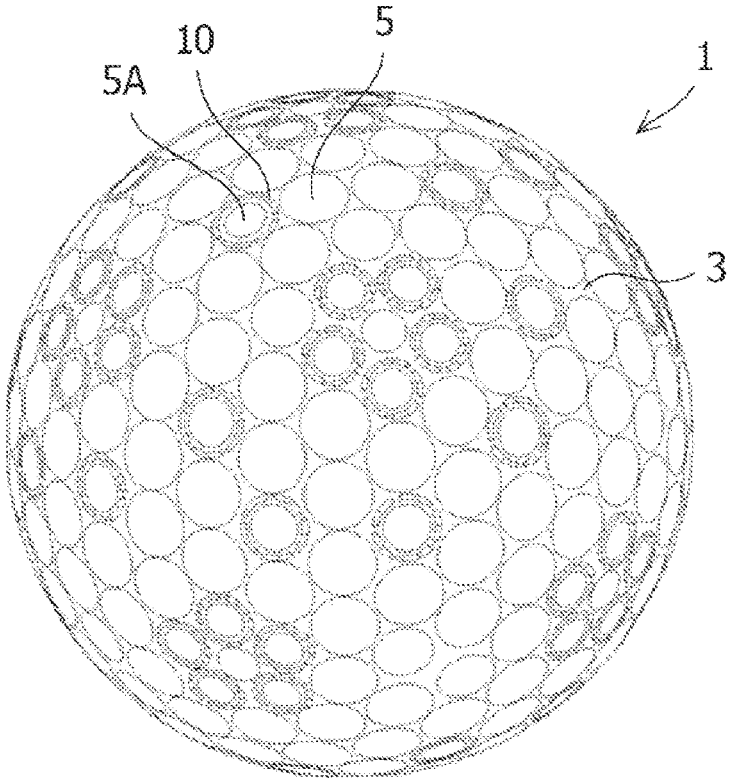
FIG. 1 is a perspective view showing an embodiment of a golf ball according to the present invention.

As shown in FIG. 1, plural dimples 5 are formed on a surface of a golf ball 1 according to the present embodiment. An area between the dimples 5 on the surface of the golf ball 1 is generally called a land 3. The land 3 constitutes the spherical surface of the golf ball 1 and has a surface with constant curvature in any portion thereof.

The dimple 5 has a planar shape on the surface of the golf ball 1 (i.e., a boundary shape between the dimple 5 and the land 3 viewed from a direction perpendicular to the dimple). There may be one or more types of the planar shape on a golf ball, of which at least one is a circular shape in the present embodiment. In combination with such a circular shape on a golf ball, there may be a polygonal shape such as quadrangular, hexagonal and octagonal shapes, and there may be a non-circular shape formed by one or more straight lines and one or more curves. In addition, there may be dimples having similar shapes such as circular or polygonal shapes with different sizes.

Plural depressed or protruded portions 10 are arranged on the land 3 and are spaced apart from each other to surround an outer periphery of at least one dimple 5A among the dimples 5. The outer peripheral length of the dimple 5A surrounded by the depressed or protruded portions is, as the lower limit, preferably at least 7.7 mm, more preferably at least 8.0 mm, and even more preferably 8.3 mm. The outer peripheral length of the dimple 5A is, as the upper limit, preferably at most 17.1 mm, more preferably at most 16.8 mm, and even more preferably at most 16.5 mm.

Among the plural depressed or protruded portions 10, a configuration of one depressed or protruded portion 10A will be described in detail below. It is understood that other depressed or protruded portions 10B-10E have the same configuration.

Figure 3:
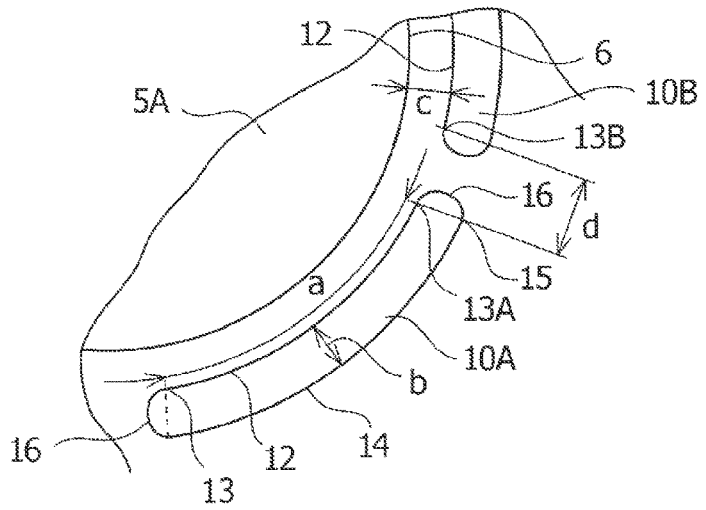
FIG. 3 is a further enlarged plan view of the dimple and the region therearound shown in FIG. 2.

As shown in FIG. 3, a depressed or protruded portion 10A has a contour including: an inner contour part 12 adjacent to the dimple 5A surrounded by this and other portions; an outer contour part 14 opposite to the adjacent side; and connecting contour parts 16 connecting between the inner contour part 12 and the outer contour part 14. Herein, the term "adjacent" is used not requiring direct contact and may also be understood as meaning "proximate" and "near". The inner contour part 12 has a shape substantially similar to an adjacent part of a contour of the dimple 5A. For example, when the dimple 5A is circular, the inner contour part 12 has a shape of a circular arc that is concentric with the circular shape of the dimple 5A. In addition to the inner contour part 12, the outer contour part 14 may have a shape substantially similar to the adjacent contour part of the dimple. For example, when the dimple 5A is circular, the outer contour part 14 also has a shape of a circular arc that is concentric with the circular shape of the dimple 5A.

A length of one depressed or protruded portion 10A (i.e. length "a" shown in FIG. 3), which is also a length of the inner contour part 12, is a length between both ends 13 of the substantially similar shape of the inner contour part 12 therealong. The end 13 of the inner contour part is an inflection point at which the curvature of the substantially similar shape of the inner contour part changes. The length "a" of the depressed or protruded portion 10A ranges from more than 1/10 to less than 1/2 of the outer peripheral length of the dimple 5A, preferably from more than 1/8 to less than 1/3 thereof, and more preferably from more than 1/6 to less than 1/4 thereof. In other words, the number of the depressed or protruded portions 10 surrounding one dimple 5A is preferably 2 to 10, more preferably 3 to 8, and even more preferably 4 to 6.

A width "b" of one depressed or protruded portion 10A is the longest distance between the inner contour part 12 and the outer contour part 14. The lower limit of the width "b" of the depressed or protruded portion 10A is preferably at least 0.1 mm, more preferably at least 0.2 mm. When the width "b" is at least 0.1 mm, the air flowing into the dimple 5A can be sufficiently disturbed by the depressed or protruded portions 10. The upper limit of the width "b" is preferably at most 1.0 mm, more preferably at most 0.5 mm.

A distance "c" from the dimple 5A to the depressed or protruded portion 10 is the shortest distance between the contour of the dimple 5A and the inner contour part 12 having the shape substantially similar thereto. The upper limit of the distance "c" from the dimple 5A is preferably at most 1 mm, more preferably at most 0.5 mm. When the distance "c" between the dimple 5A and the depressed or protruded portion 10 is at most 1 mm, the dimple surface occupation ratio, mentioned below, can be sufficiently ensured. The lower limit of the distance "c" is preferably at least 0.1 mm, more preferably at least 0.2 mm.

A distance "d" between the depressed or protruded portions 10 is a linear distance between the end 13A of the inner contour part 12 of the depressed or protruded portion 10A and an adjacent end 13B of an inner contour part 12 of an adjacent depressed or protruded portion 10B. The lower limit of the distance "d" between the depressed or protruded portions 10 is preferably at least 0.1 mm, more preferably at least 0.4 mm. The upper limit of the distance "d" is preferably at most 1.0 mm, more preferably at most 0.7 mm. When the distance "d" between the depressed or protruded portions 10 is at least 0.1 mm, the air flowing into the dimple 5A can be sufficiently disturbed. In contrast, when the distance "d" exceeds 1.0 mm, an absolute amount of the disturbed air flowing into the dimple 5A decreases and becomes insufficient.

The connecting contour part 16 of the depressed or protruded portion 10 preferably has a curved shape connecting the end 13 of the inner contour part 12 and an adjacent end 15 of the outer contour part 14, but this is not so limited.

Figure 4:
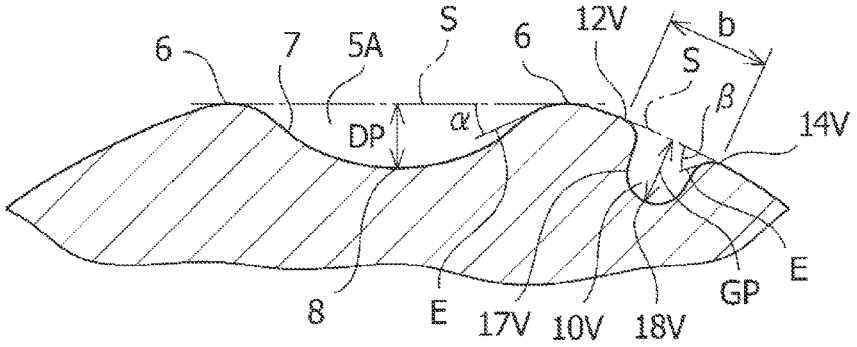
FIG. 4 is a cross-sectional view of an example of the dimple and the region therearound shown in FIG. 2, taken along the line A-A'.

In a case in which the depressed or protruded portion 10 is a depressed portion 10V, FIG. 4 is a cross-sectional view showing the dimple 5A and the depressed portion 10V along a diameter of the dimple 5A. The dimple 5A has a dimple bottom surface 7, which defines a depth DP, as shown in FIG. 4. The depth DP is a distance from a reference line S to the deepest point 8 of the dimple bottom surface 7, the reference line S being a line connecting two boundary points 6 between the dimple 5A and the land 3 (i.e., the contour of the dimple). The lower limit of the depth DP of the dimple 5A is preferably at least 0.05 mm, more preferably at least 0.10 mm. The upper limit of the depth DP of the dimple 5A is preferably at most 0.50 mm, more preferably at most 0.35 mm.

The dimple bottom surface 7 preferably has a gently curved shape in the cross sectional view along a diameter of the dimple. In particular, the curved shape of the dimple bottom surface 7 preferably has an edge angle $\alpha$ of at least 5° as the lower limit, more preferably at least 8°. The upper limit of the edge angle $\alpha$ is preferably at most 17°, more preferably at most 13°. The edge angle $\alpha$ is an angle formed by a tangential line E and the reference line S mentioned above, the tangential line E being a line that touches the curved bottom surface at a position of a depth tenth of the depth DP of the dimple.

As shown in FIG. 4, the depressed portion 10V has a depressed portion bottom surface 17V, which defines a depth GP thereof. The depth GP is a distance from a reference line S to the deepest point 18V of the depressed portion bottom surface 17V, the reference line S being a line connecting two boundary points 12V, 14V between the depressed portion 10V and the land 3 (i.e., the inner and outer contour parts of the depressed portion). The lower limit of the depth GP of the depressed portion 10V is preferably at least 0.100 mm, more preferably at least 0.105 mm. The upper limit of the depth GP of the depressed portion 10V is preferably at most 0.500 mm, more preferably at most 0.450 mm.

The depressed portion bottom surface 17V preferably has a gently curved shape in the cross sectional view along a diameter of the dimple. In particular, the curved shape of the dimple bottom surface 17V preferably has an edge angle $\beta$ of is at least 5° as the lower limit, more preferably at least 10°. The upper limit of the edge angle $\beta$ is preferably at most 90°, more preferably at most 60°. he edge angle $\beta$ is an angle formed by a tangential line E and the reference line S mentioned above, the tangential line E being a line that touches the curved bottom surface at a position of a depth tenth of the depth GP of the depressed portion.

Figure 5:
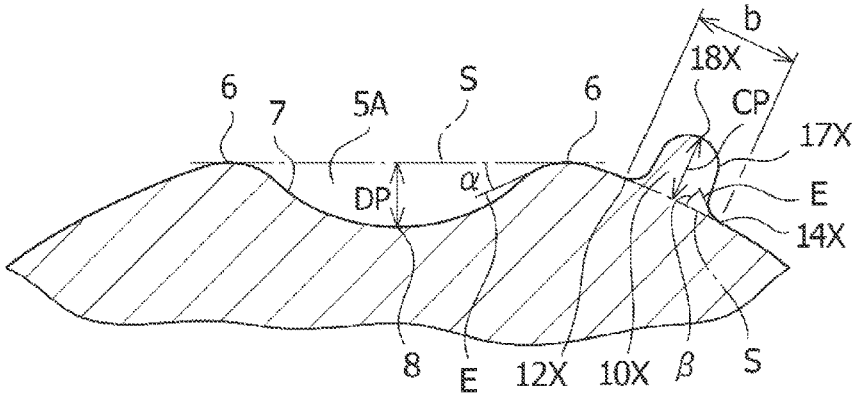
FIG. 5 is a cross-sectional view of another example of the dimple and the region therearound shown in FIG. 2, taken along the line A-A'.

In a case in which the depressed or protruded portion 10 is a protruded portion 10X, FIG. 5 is a cross sectional view showing the dimple 5A and the protruded portion 10X along a diameter of the dimple 5A. As shown in FIG. 5, the protruded portion 10X has a protruded portion surface 17X, which defines a height CP thereof. The height CP is a distance from a reference line S to the highest point 18X of the protruded portion surface 17X, the reference line S being a line connecting two boundary points 12X, 14X between the protruded portion 10X and the land 3 (i.e., the inner contour and the outer contour of the protruded portion). The lower limit of the height CP of the protruded portion 10X is at least preferably 0.100 mm, more preferably at least 0.105 mm. The upper limit of the height CP of the protruded portion 10X is preferably at most 0.500 mm, more preferably at most 0.450 mm.

The protruded portion surface 17X preferably has a gently curved shape in the cross sectional view along a diameter of the dimple. In particular, the curved shape of the protruded portion bottom surface 17X preferably has an edge angle β of at least 5° as the lower limit, more preferably at least 10°, similar to the depressed portion discussed above. The upper limit of the edge angle β is preferably at most 90°, more preferably at most 60°. The edge angle β is an angle formed by a tangential line E and the reference line S mentioned above, the tangential line E being a line that touches the curved surface of the depressed portion at a position of a height tenth of the height CP of the protruded portion.

Figure 2:
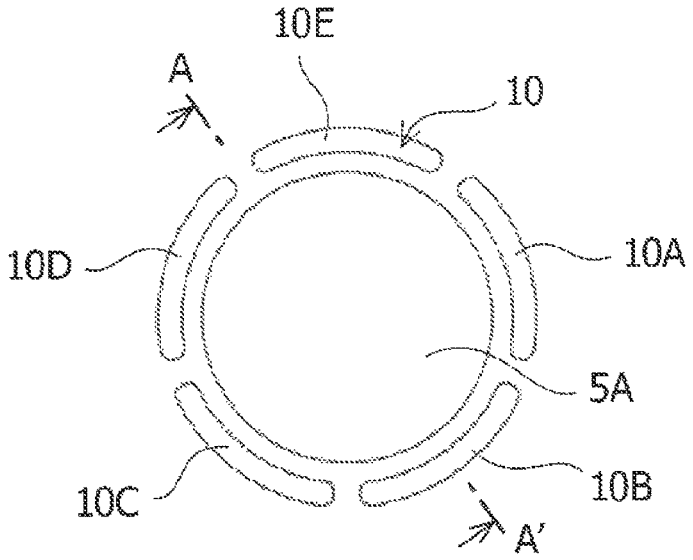
FIG. 2 is an enlarged plan view of one dimple and a region therearound on the golf ball shown in FIG. 1.

The embodiments of the dimples 5 and the depressed or protruded portions 10 have been described above, in which the five depressed or protruded portions 10A to 10E having a uniform width are arranged in a line along the outer periphery of the circular dimple 5A, as shown in FIGS. 1 and 2, but the present invention is not limited to these shapes and the arrangements. Other embodiments of the present invention may be implemented with a variety of shapes and arrangements, as shown in FIGS. 6 to 11.

Figure 6:
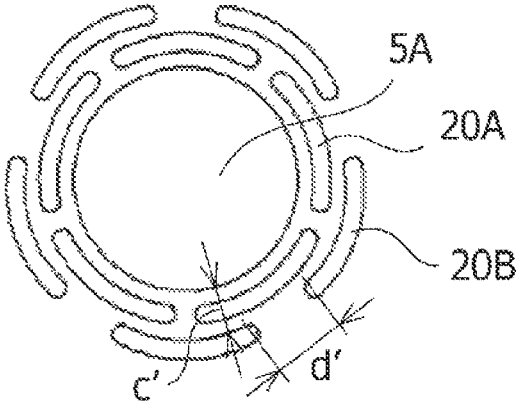
FIG. 6 is a plan view showing another embodiment of one dimple and a region therearound on a golf ball according to the present invention.

For example, as shown in FIG. 6, plural depressed or protruded portions 20 may be arranged in two lines along the outer periphery of the circular dimple 5A so as to doubly surround the dimple 5A. An inner depressed or protruded portion 20A among the two lines of depressed or protruded portion 20 may have a length "a", a width "b", a distance "c" from the dimple, a distance "d" between the depressed or protruded portions, a depth GP or height CP, and an edge angle β similar to the preferable ranges of those of the embodiment illustrated in FIG. 2, in which the depressed or protruded portion are arranged in a line. An outer depressed or protruded portion 20B may have a length "a", a width "b", a depth GP or height CP, and an edge angle β similar to the preferable range of those of the inner depressed or protruded portion 20A.

A distance "c'" from the periphery of the dimple 5A to the outer depressed or protruded portion 20B is preferably at least 0.3 mm as the lower limit, more preferably at least 0.6 mm. The upper limit of the distance "c'" is preferably at most 3 mm, more preferably at most 1.5 mm. A distance "d'" between the outer depressed or protruded portions 20B is preferably at least 0.2 mm as the lower limit, more preferably at least 0.8 mm. The upper limit of the distance "d'" is preferably at most 2 mm, more preferably at most 1.7 mm.

Figure 7:
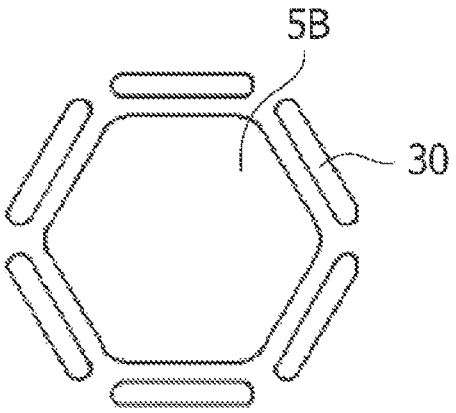
FIG. 7 is a plan view showing another embodiment of one dimple and a region therearound on a golf ball according to the present invention.

As shown in FIG. 7, plural depressed or protruded portions 30 may be spaced apart from each other and arranged along an outer periphery of a substantially hexagonal dimple 5B. In this embodiment, the depressed or protruded portions 30 may be arranged outside only the sides of the polygonal shape or alternatively may be arranged outside the sides and the corners of the polygonal shape. When the depressed or protruded portions 30 are arranged outside only the sides of the polygonal shape, inner and outer contour parts of the depressed or protruded portions 30 each has a straight shape. The depressed or protruded portion 30 may have a length "a", a width "b", a distance "c" from the dimple, a distance "d" between the depressed or protruded portions, a depth GP or height CP, and an edge angle β similar to the preferable ranges of those of the embodiment illustrated in FIG. 2.

Figure 8:
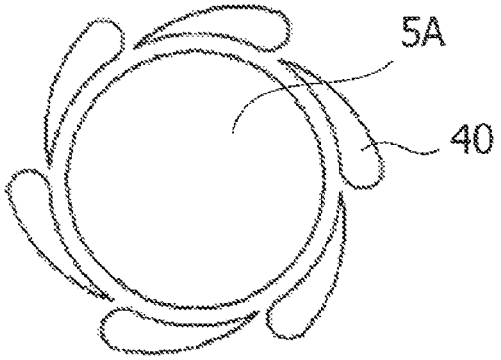
FIG. 8 is a plan view showing another embodiment of one dimple and a region therearound on a golf ball according to the present invention.

As shown in FIG. 8, plural depressed or protruded portions 40 having a water-drop shape may be spaced apart from each other and be arranged along the outer periphery of the circular dimple 5A. In this embodiment, only an inner contour part of the depressed or protruded portion 40 has a shape substantially similar to a part of the contour shape of the dimple 5A. The depressed or protruded portion 40 may have a length "a", a width "b", a distance "c" from the dimple, a distance "d" between the depressed or protruded portions, a depth GP or height CP, and an edge angle β similar to the preferable ranges of those of the embodiment illustrated in FIG. 2. In this embodiment, the edge angle β is an angle measured at an end of the inner contour part having a largest width from the outer contour part, whereas the depressed or protruded portion 40 has opposite ends having different widths between the inner and outer contour parts.

Figure 9:
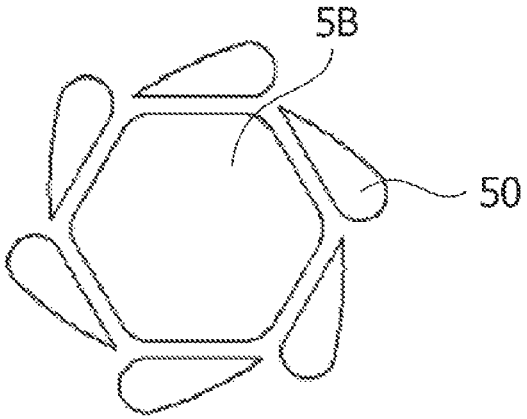
FIG. 9 is a plan view showing another embodiment of one dimple and a region therearound on a golf ball according to the present invention.

As shown in FIG. 9, plural depressed or protruded portions 50 having a water-drop shape may be spaced apart from each other and be arranged along the outer periphery of the substantially hexagonal dimple 5B. The depressed or protruded portions 50 are preferably arranged outside only the sides of the polygonal shape. When the depressed or protruded portions 50 are arranged outside only the sides, an inner contour part of the depressed or protruded portions 50 has a straight shape. The depressed or protruded portion 50 may have a length "a", a width "b", a distance "c" from the dimple, a distance "d" between the depressed or protruded portions, a depth GP or height CP, and an edge angle β similar to the preferable ranges of those of the embodiment illustrated in FIG. 7. The edge angle β is measured under the same conditions as the embodiment illustrated in FIG. 8.

Figure 10:
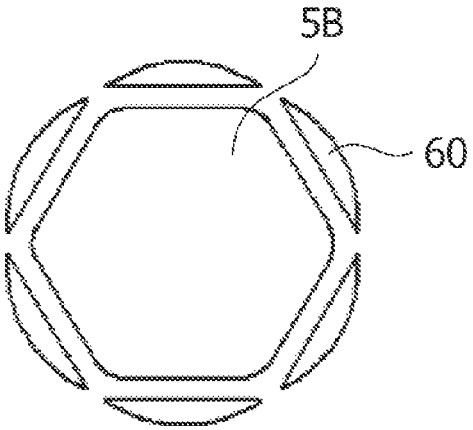
FIG. 10 is a plan view showing another embodiment of one dimple and a region therearound on a golf ball according to the present invention.

As shown in FIG. 10, plural depressed or protruded portions 60 having a shape of a circular segment may be spaced apart from each other and be arranged along the outer periphery of the substantially hexagonal dimple 5B. In this embodiment, the depressed or protruded portions 60 may be arranged outside only the sides of the polygonal shape or alternatively may be arranged outside the sides and the corners of the polygonal shape. When the depressed or protruded portions 60 are arranged outside only the sides, an inner contour part of the depressed or protruded portions 50 has a straight shape, and an outer contour part has a circular arc shape. In particular, it is preferable that the outer contour parts of the plural depressed or protruded portions 60 form a circular shape in combination, whereas the outer contour parts are spaced apart from each other. The depressed or protruded portion 50 may have a length "a", a width "b", a distance "c" from the dimple, a distance "d" between the depressed or protruded portions, a depth GP or height CP, and an edge angle β similar to the preferable ranges of those of the embodiment illustrated in FIG. 7. The edge angle β is measured at a center position of the inner contour part.

Figure 11:
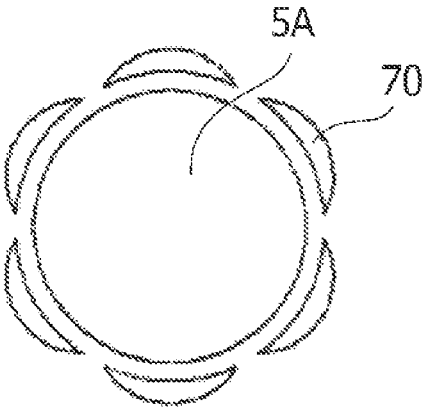
FIG. 11 is a plan view showing another embodiment of one dimple and a region therearound on a golf ball according to the present invention.

As shown in FIG. 11, plural depressed or protruded portions 60 having a shape of a circular arc may be spaced apart from each other and arranged along the outer periphery of the circular dimple 5A. An inner contour part of the depressed or protruded portion 60 has a shape of the first circular arc that is concentric to the circular dimple, and an outer contour part has a shape of the second circular arc with a radius of curvature smaller than that of the first circular arc. The depressed or protruded portion 60 may have a length "a", a width "b", a distance "c" from the dimple, a distance "d" between the depressed or protruded portions, a depth GP or height CP, and an edge angle β similar to the preferable ranges of those of the embodiment illustrated in FIG. 2. The edge angle β is measured under the same conditions as the embodiment illustrated in FIG. 10.

In the embodiments shown in FIGS. 1, 2, and 6 to 11, the number of the depressed portions or the protruded portions is five or six, but the present invention is not limited to these configurations. When the depressed or protruded portions surround the dimple in one line, two to ten depressed or protruded portions are preferably arranged for one dimple 5A, 5B. The plural depressed or protruded portions may surround one dimple in plural lines such as two or three lines. In this case, two to ten depressed or protruded portions are preferably arranged to form each of the lines.

It is not required that the above-described depressed portions or protruded portions 10 to 70 are arranged on the outer periphery of all the dimples 5 formed on the surface of the golf ball 1. It is necessary that the depressed portions or protruded portions be arranged on the outer periphery of at least one dimple, and it is preferable to arrange the depressed portions or protruded portions for 5% or more, more preferably 15% or more of the total number of the dimples. Alternatively, the depressed portions or protruded portions may be arranged on the outer periphery of all the dimples, and it is more preferable that the depressed portions or protruded portions be arranged for 70% or less of the total number of the dimples. Further, it is preferable to arrange the dimples 5A, around which the depressed portions or protruded portions are arranged on the outer periphery thereof, uniformly for the entire surface of the golf ball 1 in order to exhibit superior aerodynamic isotropy and improve air resistance. Further, as illustrated in FIG. 1, a plurality of the dimples 5A that are respectively surrounded by the above-described depressed portions or protruded portions may be arranged so as to further surround the outer periphery of a dimple 5 not surrounded by depressed portions or protruded portions.

The upper limit of the total number of the dimples is preferably not more than 500, and more preferably not more than 450, although it is not limited to these numbers. The lower limit of the total number of the dimples is preferably 200 or more, and more preferably 250 or more, although it is not limited to these numbers.

Further, in the present invention, the surface occupation ratio of the dimples (i.e., a ratio of the total area occupied by the dimples to the entire surface area of a virtual sphere of the golf ball obtained by assuming that no dimple is formed on the golf ball surface). For the surface occupation ratio of the dimples, the area of the dimples 5, 5A are counted, but the area of the depressed portions or protruded portions 10 is not included in the area of the dimples. A surface occupation ratio SR of the dimples is preferably 70% or higher, more preferably 75% or higher. The upper limit of the surface occupation ratio SR of the dimples is not particularly limited; however, a ratio of 99% or less is preferable. It is particularly preferable to arrange at least three types of dimples with different sizes. With this configuration, the dimples can be arranged uniformly on the spherical surface of the golf ball without a gap.

The golf ball according to the present invention can be produced by using dies. In producing such dies, a method in which three-dimensional computer-aided design (3DCAD) or three-dimensional computer-aided design (3DCAM) is used and the shape of the entire surface is directly formed on reverse master dies by three-dimensional cutting can be used, or a method in which cavities on molding dies are directly formed by three-dimensional cutting can be used. By designing the die so that the parting line of the dies passes the land on the golf ball surface, the finishing (trimming) can be easily performed. In order to arrange the dimples on the spherical surface of the golf ball in an unbiased manner, it is preferable to use arrangement methods such as polyhedrons including an icosahedron, a dodecahedron, or an octahedron, or rotation symmetry such as three-fold rotation symmetry or five-fold rotation symmetry.

EXAMPLES

For the arrangement of the dimples formed on the surface of the golf ball and the arrangement of the depressed portions arranged on the outer periphery of the dimple, patterns 1, 2, and 3 illustrated in FIGS. 2, 6, and 7 were employed. Specific dimensions and the angles for the respective patterns are shown in Table 1. Respective dimensions and angles set when protruded portions are arranged are shown in Table 2.

TABLE 1

| | Arrangement of dimples and depressed portions | | |
|---|---|---|---|
| | Pattern 1 | Pattern 2 | Pattern 3 |
| Peripheral length of dimple [mm] | 13.509 | 13.509 | 12.727 |
| Edge angle of dimple (α) (°) | 10 | 10 | 11 |
| Length of depressed portion (a) [mm] | 2.417 | 2.417 | 1.815 |
| Width of depressed portion (b) [mm] | 0.35 | 0.35 | 0.35 |
| Distance between dimple depressed portions (c) [mm] | 0.30 | Inner: 0.30<br>Outer: 0.90 | 0.30 |
| Distance between depressed portions (d) [mm] | 0.66 | Inner: 0.66<br>Outer: 1.445 | 0.615 |
| Depth of depressed portion (GP) [mm] | 0.15 | 0.15 | 0.15 |
| Edge angle of depressed portion (β) [°] | 17 | 17 | 17 |

TABLE 2

| | Arrangement of dimples and protruded portions | | |
|---|---|---|---|
| | Pattern 1 | Pattern 2 | Pattern 3 |
| Peripheral length of dimple [mm] | 13.509 | 13.509 | 12.727 |
| Edge angle of dimple (α) (°) | 10 | 10 | 11 |
| Length of protruded portion (a) [mm] | 2.417 | 2.417 | 1.815 |
| Width of protruded portion (b) [mm] | 0.35 | 0.35 | 0.35 |
| Distance between dimple protruded portions (c) [mm] | 0.30 | Inner: 0.30<br>Outer: 0.90 | 0.30 |
| Distance between protruded portions (d) [mm] | 0.66 | Inner: 0.66<br>Outer: 1.445 | 0.615 |
| Height of protruded portion (GP) [mm] | 0.10 | 0.10 | 0.10 |
| Edge angle of protruded portion (β) [°] | 17 | 17 | 17 |

Figure 12:
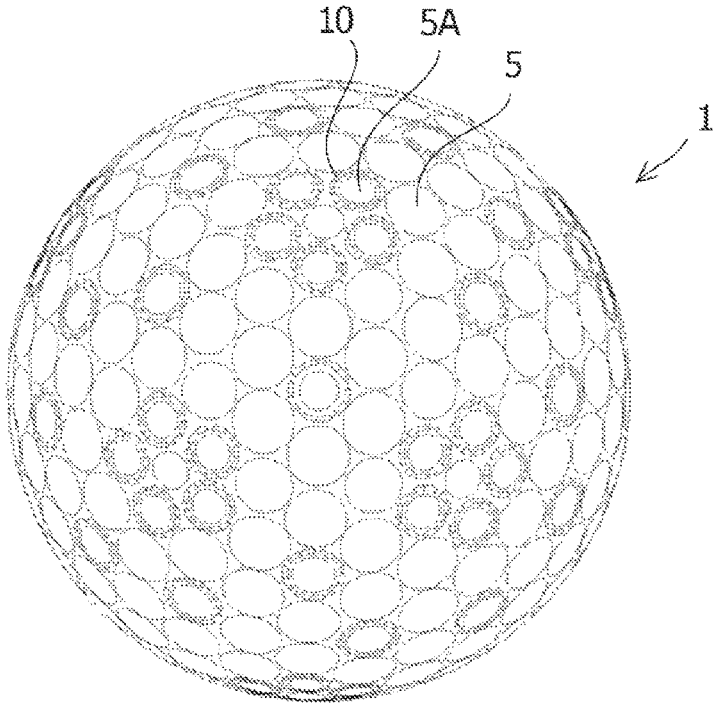
FIG. 12 is a front view of the golf ball shown in FIG. 1.
Figure 13:
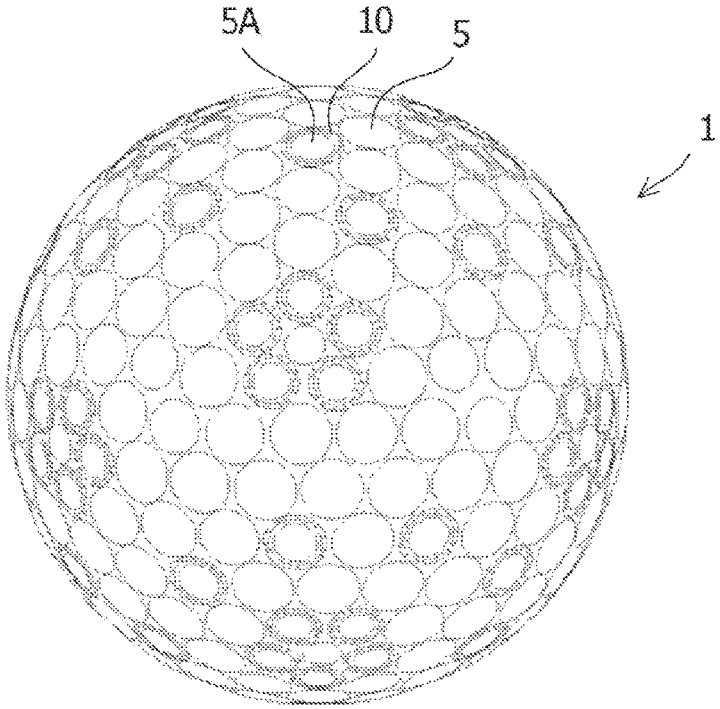
FIG. 13 is a side view of the golf ball shown in FIG. 1.

The dimples were arranged on the surface of the golf ball by using the respective patterns for the dimples and the depressed portions shown in Table 1 (Examples 1 to 6). As Comparative Examples, dimples were also arranged on the golf ball without arranging any depressed portions or protruded portions (Comparative Examples 1, 2). Conditions for the Comparative Examples are shown in Table 3. For the arrangement of the dimples in Example 2, a perspective view thereof is shown in FIG. 1, a front view is illustrated in FIG. 12, and a side view is shown in FIG. 13.

TABLE 3

| | Example | | | | | | Comparative Example | |
|---|---|---|---|---|---|---|---|---|
| | 1 | 2 | 3 | 4 | 5 | 6 | 1 | 2 |
| Arrangement pattern | 1 | 1 | 1 | 1 | 2 | 3 | — | — |
| Total number of dimples (X) | 338 | 338 | 338 | 338 | 338 | 338 | 338 | 330 |
| Surface occupation ratio [%] | 80 | 80 | 80 | 80 | 80 | 80 | 80 | 80 |
| Number of dimples with depressed portions (Y) | 50 | 92 | 180 | 338 | 50 | 92 | — | — |
| Ratio of dimples with depressed portions (Y/X) [%] | 14.8 | 27.2 | 53.3 | 100.0 | 14.8 | 27.2 | — | — |
| Flight distance | 221.1 | 227.2 | 226.6 | 224.7 | 222.4 | 219.5 | 216.3 | 213.7 |
| Speed maintenance factor [%] | 75.2 | 77.5 | 77.3 | 76.5 | 75.8 | 74.7 | 73.6 | 72.7 |

The flight distance and the speed maintenance factor were simulated for the respective golf balls of Examples and Comparative Examples. The results are shown in Table 3.

The evaluation for the flight distance was carried out by using a golf ball hitting robot with a driver W #1 mounted thereto, and the flight distance (the carry) of the ball reached when a sample ball was hit at a head speed of 45 m/s, a ball hitting angle of 10°, and a spin rate of 2,800 rpm was calculated.

For the evaluation for the speed maintenance factor, the speed of the golf ball at the time of hitting it and the speed of the golf ball 1 second after the hitting were respectively calculated under the above-described conditions for evaluating the flight distance, and the ratio of maintaining the speed at the time of the hitting after 1 second from the hitting was calculated.

As shown in Table 3, compared with the golf balls of Comparative Examples 1 and 2, the results of the flight distance and the speed maintenance factor of the golf balls of Examples 1 to 6, of which the dimples included specific depressed portions arranged therein, all improved.

What is claimed is:

1. A golf ball comprising:

plural dimples formed on a surface thereof; and plural depressed or protruded portions spaced apart from each other and arranged along and outside an outer periphery of at least one of the plural dimples, the plural depressed or protruded portions each having, as a part of a contour thereof, a shape substantially similar to a part of a contour of the dimple surrounded with the plural depressed or protruded portions, the plural depressed or protruded portions each having a length of more than 1/10 and less than 1/2 of an outer peripheral length of the dimple surrounded with the plural depressed or protruded portions, wherein the plural depressed or protruded portions each has a width smaller than the length thereof, the length of the depressed or protruded portion being along a length of an inner contour part of the depressed or protruded portion between both ends of the substantially similar shape to a contour part of the dimple, and the width of the depressed or protruded portion being a longest distance between the inner contour part and an outer contour part of the depressed or protruded portion, wherein the inner contour part and the outer contour part of the depressed or protruded portion have the substantially same shape, and the depressed or protruded portion has a substantially uniform width.

2. The golf ball according to claim 1, wherein a distance between the plural depressed or protruded portions and the dimple surrounded with the plural depressed or protruded portions is at most 1 mm.

3. The golf ball according to claim 1, wherein the contour of the depressed or protruded portion comprises a first part adjacent to the dimple and a second part opposite thereto, the first and second parts each having a shape of a circular arc, the circular arcs being concentric.

4. The golf ball according to claim 1, wherein the contour of the depressed or protruded portion comprises a first part adjacent to the dimple and a second part opposite thereto, the first part having a shape of a straight line, the second part having a shape of a curve.

5. The golf ball according to claim 1, wherein the plural depressed or protruded portions are arranged doubly or more along the outer periphery of the dimple.

6. The golf ball according to claim 1, wherein a depth of the depressed portion or a height of the protruded portion is at most 0.5 mm.

7. The golf ball according to claim 1, wherein the width of the depressed or protruded portion is at most 1.0 mm.

* * * * *